US010926986B2

(12) United States Patent
Parot et al.

(10) Patent No.: US 10,926,986 B2
(45) Date of Patent: Feb. 23, 2021

(54) CONTROL STATION FOR A WORK PLATFORM OF AN AERIAL LIFT

(71) Applicant: HAULOTTE GROUP, L'horme (FR)

(72) Inventors: Sébastien Parot, Saint-Martin-la-Plaine (FR); Philippe Luminet, Lyons (FR); Nicolas Bonnefoy, Saint-Chamond (FR)

(73) Assignee: HAULOTTE GROUP, L'horme (FR)

( * ) Notice: Subject to any disclaimer, the term of this patent is extended or adjusted under 35 U.S.C. 154(b) by 249 days.

(21) Appl. No.: 15/781,638

(22) PCT Filed: Dec. 3, 2016

(86) PCT No.: PCT/FR2016/053201
§ 371 (c)(1),
(2) Date: Jun. 5, 2018

(87) PCT Pub. No.: WO2017/098120
PCT Pub. Date: Jun. 15, 2017

(65) Prior Publication Data

US 2020/0198951 A1 Jun. 25, 2020

(30) Foreign Application Priority Data

Dec. 8, 2015 (FR) ..... 1562021

(51) Int. Cl.
*B66F 17/00* (2006.01)
*B66F 11/04* (2006.01)

(52) U.S. Cl.
CPC ..... *B66F 17/006* (2013.01); *B66F 11/044* (2013.01)

(58) Field of Classification Search
CPC ..... B66F 9/20; B66F 11/04; B66F 11/042; B66F 11/044; B66F 11/046; B66F 17/006
See application file for complete search history.

(56) References Cited

U.S. PATENT DOCUMENTS 3,605,941 A * 9/1971 Edwards ..... B66F 11/046 182/2.1
3,638,758 A * 2/1972 Weisker ..... B66F 9/07545 182/112

(Continued)

FOREIGN PATENT DOCUMENTS

EP 2 096 078 A 9/2009
FR 3 007 401 A1 12/2014

(Continued)

*Primary Examiner* — Colleen M Chavchavadze
(74) *Attorney, Agent, or Firm* — 24IP Law Group USA, PLLC; Timothy DeWitt

(57) ABSTRACT

The control station 20 of the work platform 10 of an aerial work platform comprises:

a control console;

a cover 40 for protecting the console, which can be moved between a closed position and an open position;

a longitudinal element—such as a bar 42—coupled to the cover to simultaneously move between the closed and open positions, with the longitudinal element protruding from the front side of the console when the cover is open; and means for detecting an external action pushing the longitudinal element toward the console when the cover is open.

This makes it possible to keep the operator safe from being crushed against the console when moving the platform. Besides, the longitudinal element is not an obstacle to the opening or closing of the cover and is put aside when the cover is closed, thus preventing same to be exposed to shocks.

20 Claims, 9 Drawing Sheets

(56) References Cited

U.S. PATENT DOCUMENTS 3,844,382 A * 10/1974 Mecklenburg ..... B66F 9/07545 187/222
4,202,565 A * 5/1980 Mosch ..... B66F 9/07545 280/756
4,429,761 A * 2/1984 Haddock, Jr. ..... B66F 9/20 180/271
4,979,588 A * 12/1990 Pike ..... B66C 15/06 182/18
6,145,619 A * 11/2000 Risser ..... B66F 11/044 182/113
6,174,124 B1 * 1/2001 Haverfield ..... B66F 9/06 182/148
8,627,925 B2 * 1/2014 Webster ..... B66F 9/127 182/113
8,801,085 B2 * 8/2014 Bourke ..... B66F 17/006 280/756
9,676,602 B2 * 6/2017 Cummings ..... B66F 17/006
9,679,461 B2 * 6/2017 Cummings ..... B66F 11/042
2002/0074186 A1 6/2002 Baldas et al.
2004/0173404 A1 * 9/2004 Kobel ..... A62B 1/22 182/2.1
2009/0260920 A1 * 10/2009 Cummings ..... B66F 11/046 182/18
2010/0200332 A1 8/2010 Bowden
2012/0152653 A1 6/2012 Bowden
2013/0233645 A1 9/2013 Hao et al.
2014/0246270 A1 * 9/2014 Parot ..... G01L 5/0004 182/63.1
2014/0332314 A1 * 11/2014 Carrillo ..... B66F 11/04 182/19
2015/0144426 A1 5/2015 Hao et al.
2016/0075543 A1 * 3/2016 Lombardo ..... B66F 17/006 187/247
2018/0362313 A1 * 12/2018 Bonnefoy ..... B66F 17/006
2019/0152753 A1 * 5/2019 Vial ..... B66F 17/006
2019/0177140 A1 * 6/2019 Gilbride ..... B66F 11/046
2019/0210854 A1 * 7/2019 Eck ..... B66F 17/006
2019/0225471 A1 * 7/2019 Luminet ..... B60Q 1/50

FOREIGN PATENT DOCUMENTS

GB 2 481 709 A 1/2012
JP 02-024760 B 7/1987
JP 64-12100 U 1/1989
JP H04 53800 U 5/1992
JP H4-65299 U 6/1992
JP H4-77600 U 7/1992
JP H05 124800 5/1993
JP 2002114500 A 4/2002
JP 2001226097 A 1/2008

* cited by examiner

CONTROL STATION FOR A WORK PLATFORM OF AN AERIAL LIFT

The present invention relates to the field of mobile elevating work platforms for persons (as designated by the acronym MEWP) still commonly called aerial work platforms. It more particularly relates to the control station arranged on the work platform of aerial work platforms.

Aerial work platforms are machines intended to enable one or more person(s) to work at heights. For this purpose, they comprise a work platform designed to accommodate people. The work platform is supported by a lifting mechanism which makes it possible to lift same from a lowered position on the frame of the aerial work platform to the desired working height position. In particular, the lifting mechanism may include an articulated and/or telescopic mast at the end of which the platform is mounted and hydraulic cylinders to extend same relative to the frame.

The lifting mechanism is often arranged on a turret which is pivotably mounted on the frame, which makes it possible to change the orientation of the lifting mechanism—and thus of the platform—relative to the frame. Eventually, the frame is generally equipped with wheels or tracks making it possible to move the aerial lift on the ground. It is most often motorized to enable an autonomous ground travel of the aerial work platform.

The platform is equipped with a control station enabling an operator aboard the platform to cause the platform to move to reach the desired working position. For this purpose, it comprises a console provided with control members enabling the operator to actuate the lifting mechanism, or even the pivoting of the turret and possibly also the movement of the aerial work platform on the ground.

When the platform moves as caused by an operator at the control console of the platform, the risk exists for the operator to be crushed against the control console by an external obstacle—for example a part of a building, an engineering structure or a tree branch—which might hit him/her from behind.

To protect the operator against this risk, WO 2011/015815 A1 teaches to pivotably mount the control console on the guard railing against return springs. When the operator gets crushed against the console, the latter is pivoted against the return springs and a proximity sensor detects such pivoting to stop the platform movement. A drawback of this solution lies in the fact that the operator can in normal use apply significant stresses onto the console, for instance when holding himself at the control members to avoid being unbalanced by the movements of the platform. In order to prevent inadvertent activation of the crushing detection system, the return springs must be very stiff. Therefore, crushing is detected only if the force crushing the operator against the console is very important, and he/she may thus be injured.

Positioning a safety bar at the control console so that it is interposed between the operator standing in front of the control console and the latter is also known. When the operator is hit from behind by an external obstacle during the movement of the platform, he/she is pushed by the obstacle toward the control console, comes to rest against the safety bar which causes then the movement of the platform to stop. An example of such a safety bar is disclosed in FR 3 007 401 A1 wherein the bar is mounted so as to tilt on either side of the control console.

Besides, the control station typically comprises a protective cover which can be folded over the control console. When open, it makes it possible for the operator to access the control members of the control console. When closed, it covers the control console so as to protect the control members as well as its signaling members, if any, and the instructions on the console against dirt and shocks during the work executed by people aboard the platform.

Such control stations equipped with a safety bar and a folding protective cover, however, have a number of drawbacks.

Thus, when closed, the cover does not generally cover the safety bar which extends above the protective cover and remains exposed to shocks when persons work aboard the platform.

Moreover, the fact that both the security bar and the cover are movable relative to the console makes the design of the control station more complex, given the fact that each has its own mounting means which have to be accommodated in a limited space on the control console or around same.

Furthermore, the presence of the safety bar above the protective cover generally hinders the manipulation of the protective cover between the open and closed positions.

The object of the present invention is to overcome at least partially the above-mentioned drawbacks.

According to one aspect, the invention more particularly aims at ensuring that the safety bar, or another element with the same function, will no longer be an obstacle to handling the protective cover of the control console when opening or closing same and will be less exposed to shock when persons work aboard the work platform.

For this purpose, the present invention provides for a control station of a work platform of an aerial work platform, comprising:

- a control console whereon control members are arranged;
- a cover for protecting the control console moveably mounted between:
  - a first position in which the cover is closed to cover the control console, and
  - a second position in which the cover is open to make it possible to manipulate the control members from the front side of the console;
- a longitudinal element linked to the cover to simultaneously move between the first position and the second position, which longitudinal element extends at a distance along the front side of the console and protrudes with respect to the front side of the console when the cover is in the second position; and
- means for detecting an external action pushing the longitudinal element toward the console when the cover is in the second position.

When mounted aboard the work platform of an aerial work platform, the control station is so provided as to cause the work platform to move. More specifically, when in the open position, the cover enables an operator standing in front of the control console—i.e. in front of the front side thereof—to manipulate the control members to move the work platform. The longitudinal element is then positioned between him/her and the control console without being an obstacle to the handling and viewing of the control members by the operator. Thus, if the operator is hit from behind by an obstacle which he/she did not pay attention to during the movement of the work platform, he/she will be pushed toward the console and therefore be urged against the longitudinal element which will thus be pushed toward the console. The operator pressing the longitudinal element is detected by the detecting means. Cooperating with the circuit controlling the various means for moving the platform, these can then stop for instance the movement in progress of the platform so as to keep the operator from being crushed against the control console and possibly initiate a light and/or sound alarm signal. The person skilled in the art suitably selects the detecting threshold so that the operator can be efficiently protected against crushing. The control station will preferably be so designed that the external action pushing the longitudinal element toward the console—which is detected by the detecting means to protect the operator against the risk of being crushed—does not cause the cover to close. For this purpose, it is sufficient for the cover to be closed by an external action in a different direction.

On the contrary, when the cover is closed, it protects the control console against dirt and shocks. Since it moves together with the protective cover between the first and second positions, the longitudinal element is no longer in the protruding position with respect to the front side of the control console when the cover is closed, but in a position spaced apart. This is acceptable because the protection against the operator being crushed against the console does not have to be active in this case. As a matter of fact, when the cover is closed, the operator generally has no access to the console control members. This situation thus does not correspond to a handling phase of the platform by an operator aboard same. However, this situation may correspond to a phase of works executed by people aboard the platform which is then stationary. Because it is positioned apart, the longitudinal element is less exposed to shocks during the work carried out by persons aboard the platform. Moreover, the handling of the cover to move it from the open position to the closed position and vice versa is no longer or less hampered because they move together.

The longitudinal element may be rigid. In this case, it may advantageously be used as a gripping means to move the cover between the open and closed positions. It is preferably straight, but may have a different, for example arched, shape. The longitudinal element may also be flexible, for example in the form of a cord drawn between two side bars fixedly arranged on the protective cover, with the detecting means operating in relation to the tension applied to the cord similarly to the technology disclosed in EP 2 096 078 A1.

The control station is preferably so designed and adapted as to be installed on the work platform of an aerial work platform so that an operator can manipulate and view the control members of a control console when standing right in front of the control console and the protective cover is open. It should also be understood that the control station is preferably so designed that, in the aforesaid position of the cover and of the operator in front of the console, the operator pushes the longitudinal element with either the torso or the waist when pushed toward the console by an obstacle hitting him/her from behind. "Operator" means a normally proportioned reference person with a stature chosen between 1.70 m and 1.90 m.

According to a preferred embodiment, when the cover is in the second position, the longitudinal element is arranged to move toward the rear side of the console when subjected to an external action pushing same toward the console, with the detecting means operating by detecting the movement of the longitudinal element toward the rear side of the console. This movement of the longitudinal element makes it possible to limit or eliminate the crushing force applied to the operator when he/she is hit from behind by an obstacle during the movement of the platform. Besides, detecting the movement of the longitudinal element can be simply implemented, for example using a position sensor of any suitable technology: roller switch, inductive sensor, optical sensor, etc.

In this embodiment, the detecting means can advantageously be provided to operate by detecting the movement of the longitudinal element beyond a predetermined position toward the rear side of the console, with the longitudinal element being adapted to move toward the rear side of the console beyond said predetermined position. As a matter of fact, the movement of the longitudinal element beyond said predetermined position limits the force applied onto the operator when, in spite of the stop command triggered by the detecting means, the platform continues to move by inertia effect.

According to another preferred embodiment which can be implemented independently or in combination with the previous one, the detecting means operate by detecting that a threshold of the force of the external pushing action pushing the longitudinal element toward the console has been exceeded. The person skilled in the art suitably selects the detecting threshold so that the operator can be efficiently protected against crushing. Such threshold is preferably set at less than or equal to 40 daN and even more preferably less than or equal to 20 daN. However, the detecting threshold should preferably be high enough to avoid the undesired triggering of the detecting means in case of the operator's inadvertent activation of the longitudinal element in the absence of a crushing risk. It is selected notably by taking into account whether the detecting means operate with respect to a movement of the longitudinal element or not, and the range and conditions of such movement if any. If such means do not operate with respect to a movement of the longitudinal element, the detecting threshold is preferably set to at least 10 daN.

Whatever the above embodiment, it may advantageously be provided that, when the cover is in the second position, the longitudinal element is held in position against an external action pushing the longitudinal element toward the control console up to a given level of pushing force beyond which the longitudinal element moves toward the rear side of the console. This movement of the longitudinal element makes it possible to limit or eliminate the crushing force applied to the operator when he/she is hit from behind by an obstacle during the movement of the platform. Such holding in position makes it possible to avoid the undesired triggering of the detecting means in case of inadvertent activation by the operator of the longitudinal element in the absence of a crushing risk. The person skilled in the art appropriately selects the given level of pushing force to provide an efficient protection of the operator against crushing. It is preferably set at a value less than or equal to 40 daN, more preferably less than or equal to 20 daN, even more preferably less than or equal to 10 daN. When the detecting means operate by detecting that a threshold of the force of the external pushing action pushing the longitudinal element toward the console has been exceeded independently of the movement of the longitudinal element towards the rear of the console, the detecting threshold and the given level of pushing force will preferably be coordinated so as to provide full security to the operator. For this purpose, the detecting threshold is so selected as to be smaller than the given level of the pushing force so that the detecting means can trigger and cause the movement of the platform to stop prior to the movement of the longitudinal element. Thus, if the platform continues to move by inertia effect, the longitudinal element will move toward the rear side of the console as soon as the given level of the pushing force is exceeded in turn, which will advantageously be a relief for the operator. This case may correspond to a longitudinal element formed as a rigid bar responsive to the force as disclosed in GB 2 481 709 A which may for example be arranged fixedly on the protective cover, with the latter being mounted so that it can move to the rear side of the console to provide the bar with the capacity to move in that direction.

It is advantageous that the longitudinal element is thus held in position by return means developing a preferably elastic returning force onto the longitudinal element throughout the movement of the longitudinal member toward the rear side of the console. Thus, when the external pushing action on the longitudinal element disappears, the latter is returned to its rest position.

In this case, it is still advantageous for the detecting means to operate by detecting the movement of the longitudinal element beyond a predetermined position toward the rear side of the console and, on the one hand, for the distance as measured in straight line between the predetermined position for detecting the movement of the longitudinal element and the position of the longitudinal element in the absence of external action pushing same toward the console—i.e. its rest position—when the cover is in the second position, to be greater than or equal to 2 cm, and on the other hand, for the pushing force required to move the longitudinal element up to the predetermined detecting position thereof to be less than or equal to 10 daN. As a matter of fact, these measures provide a very effective protection of the operator against crushing due to the low activation force required while avoiding an inadvertent activation of the detecting means due to the moving distance required for the longitudinal element thereon if the operator unintentionally presses same in the absence of any crushing risk. However, the pushing force required to move the longitudinal element to its predetermined detecting position should preferably be chosen so as to be greater or equal to 2 daN in order to avoid excessive triggering sensitivity notably with respect to accelerations of the platform. On the other hand, if the aforementioned distance between the predetermined position for detecting the movement of the longitudinal element and the rest position of same when the cover is open is less than 2 cm, then the pushing force required to move the longitudinal element up to its predetermined detecting position is preferably selected to be at least 10 daN.

According to one embodiment, the cover moves between the first position and the second position by tilting or more precisely by pivoting. This allows a placement of the longitudinal element apart which is particularly adapted to protect same against shocks and dirt when the cover is in the closed position. Moreover, the pivoting mounting is particularly reliable and can be easily implemented.

According to one embodiment, the longitudinal element is fixedly arranged on the cover. This embodiment is particularly advantageous regardless of the interest of placing apart the longitudinal element to protect same from shocks and dirt when the cover is closed. As a matter of fact, it makes the assembling of the cover and the longitudinal element on the control console or around it simpler since it makes it possible not to use mounting elements specific to the longitudinal element for this purpose and the fixed arrangement thereof to the cover can be easily implemented. Besides, when the longitudinal element can move toward the rear side of the console, it avoids the risk of interference between the longitudinal element or the supporting elements—as well as the operator's fingers if he/she holds same—with the cover as they move together. Moreover, if the detecting means operate by detecting the movement of the longitudinal element toward the rear side of the console, it should be understood that such detection can be implemented with any suitable sensor cooperating with the cover to detect the movement of the latter since both move together, which is advantageously easy to implement.

In this embodiment, the longitudinal element is advantageously either the front edge of the cover, or a bar arranged on the cover at a distance from the front edge of the cover to define at least one free space between the bar and the front edge of cover, being mentioned that the front edge of the cover is the edge of the cover located toward the front side of the console when the cover is in the second position. In this case, the cover may have an area adjacent to the front edge which is made of transparent or translucent material through which the control members of the console are visible when the cover is in the second position. It can also be provided for the control members of the console to be visible through the at least one free space between the bar and the front edge of the cover when the cover is in the second position.

Furthermore, the cover can be provided so as to be mounted relatively to the console by a pivoting and sliding connection for moving the cover, on the one hand, by merely pivoting between the first position and the second position, and, on the other hand, by sliding toward the rear side of the console from the second position on of the cover when the longitudinal element is subjected to an external action pushing same towards the console. Using different connections for opening and detecting crushing makes it possible to separately implement the two functions to optimize the operation thereof.

The invention also relates to an aerial work platform, comprising:

- a work platform;
- a mechanism for lifting the work platform; and
- a control station according to the invention as previously described, which is arranged on the work platform;

wherein:

- the control station makes it possible for an operator to cause the work platform to move; and
- the detecting means of the control station stop the current movement of the work platform upon detecting an external action pushing the longitudinal element toward the control console when the cover is in the second position.

Other aspects, characteristics and advantages of the invention will appear upon reading the following description of a preferred embodiment of the invention, given as an example and referring to the appended drawing.

FIG. 1 shows a perspective view of an aerial work platform, the work platform of which is equipped with a control station according to a first embodiment of the invention.

FIGS. 2 and 4 each show a perspective view of the work platform of the aerial work platform of FIG. 1, with the protective cover of the control station being respectively in closed position and in open position.

FIGS. 3 and 5 show a local enlargement of FIG. 2, respectively of FIG. 4, at the control station.

FIGS. 6 and 7 respectively show a front view and a side view of the work platform of FIG. 1 with an operator standing in front of the control station.

Figure 1:
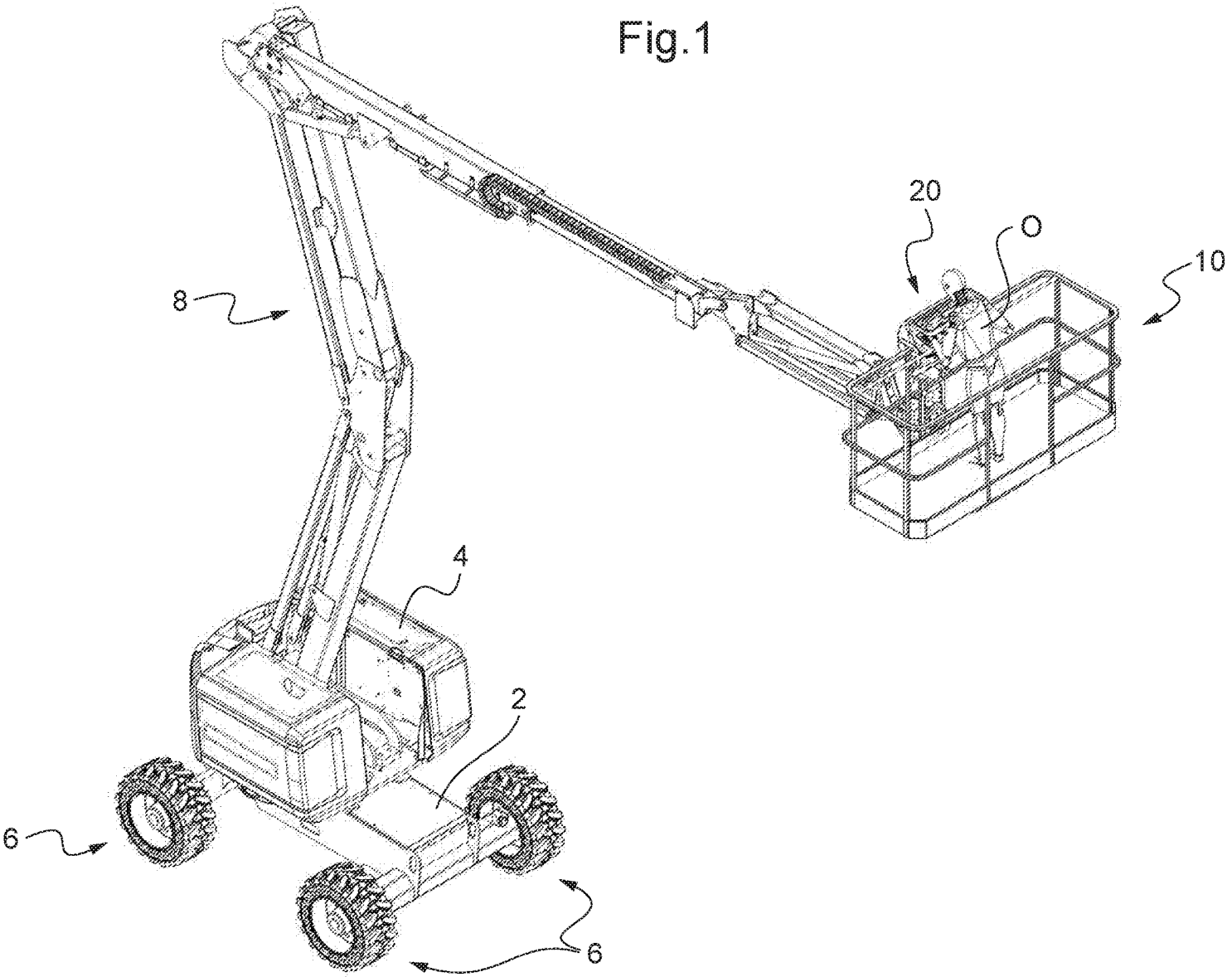
Figure 15:
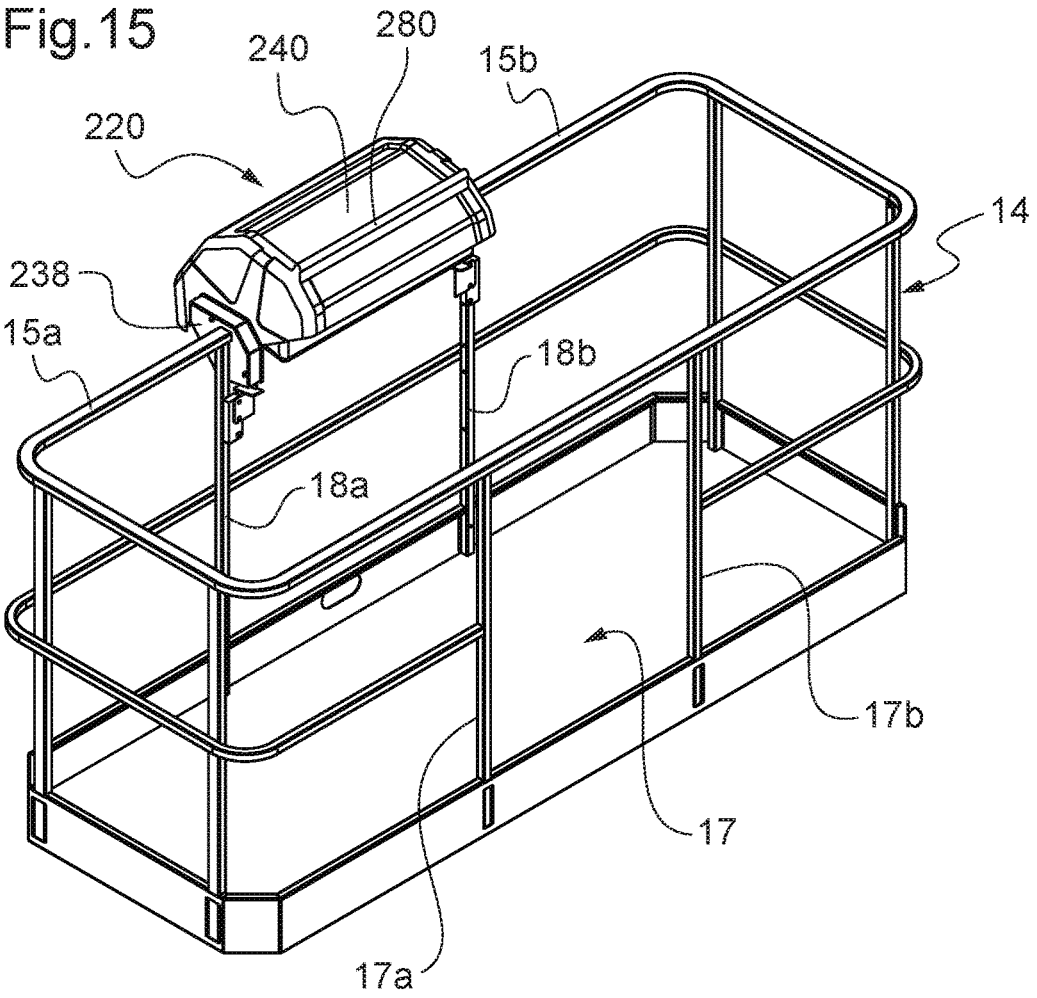
Figure 17:
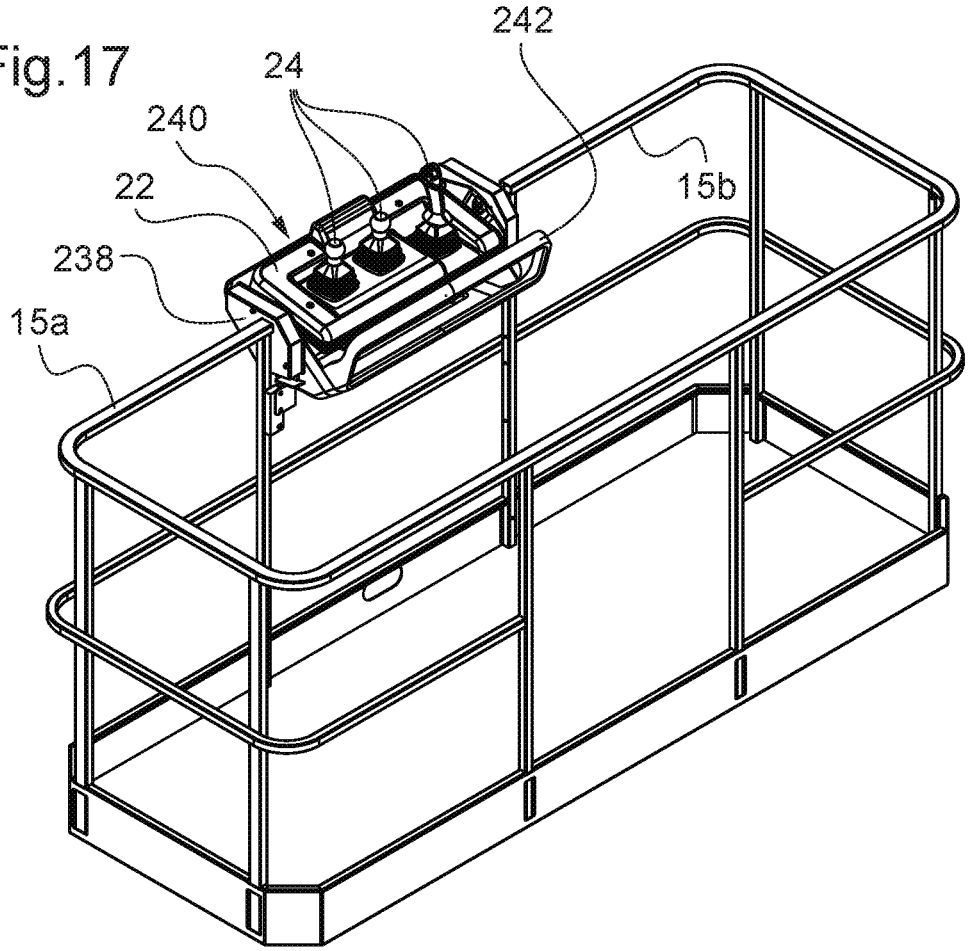

FIGS. 15 and 17 each show a perspective view of a work platform similar to that of FIG. 1 but equipped with a control station according to another embodiment, with the protective cover being respectively in closed position and in open position.

Figure 16:
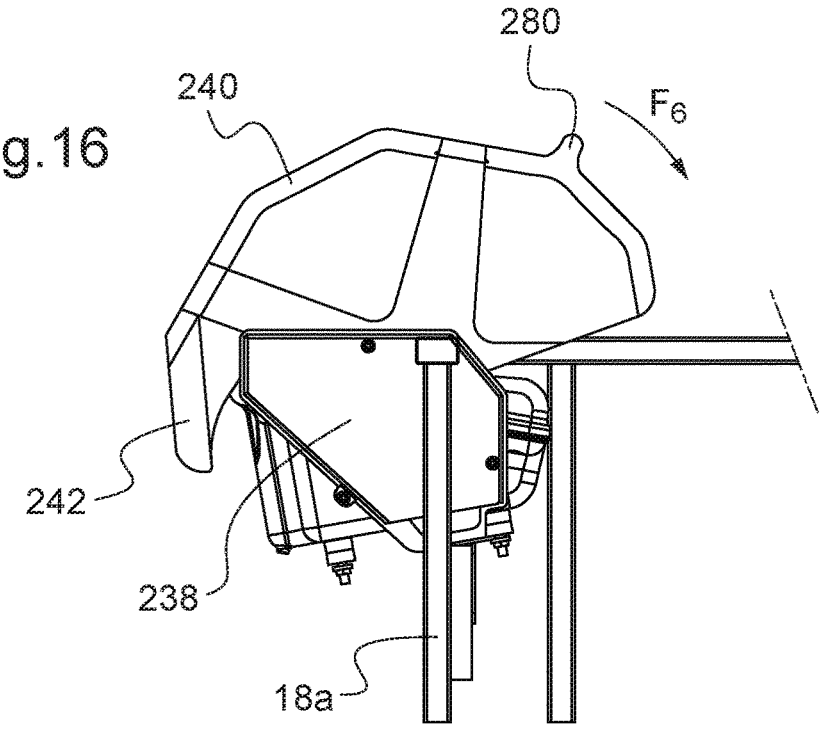
Figure 18:
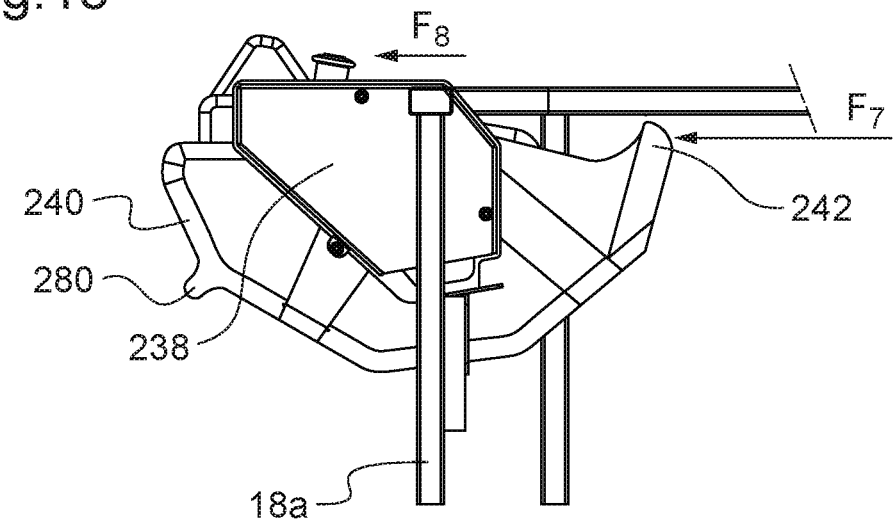

FIGS. 16 and 18 each show a side view of the control station of FIGS. 15 and 17, with the protective cover being respectively in the closed position and in the open position at rest.

A first embodiment of the invention is described now with reference to FIGS. 1 to 13. FIG. 1 illustrates an aerial work platform the work platform 10 of which is equipped with a control station 20 according to the invention.

The aerial work platform comprises a frame 2 provided with wheels 6 to move it on the ground. Alternatively or in combination, the frame 2 is equipped with tracks for the same purpose. The frame 2 is preferably motorized to ensure the independent drive of the aerial work platform on the ground.

The platform 10 is so designed as to receive one or more person(s) aboard, as well as the tools and materials to be used to work at heights. It is supported by a lifting mechanism 8 to raise it from a lowered position on the frame 2 of the aerial work platform to the desired working position at height. In this case, it comprises an articulated and/or telescopic mast, at the end of which the platform 10 is mounted and hydraulic cylinders to extend same relative to the frame 2. The lifting mechanism 8 is arranged on a motorized turret 4 which makes it possible to rotate same about a vertical axis relative to the frame 2. The turret 4 thus makes it possible to change the orientation of the lifting mechanism 8—and thus of the platform 10—relative to the frame 2.

The control station 20 enables an operator O aboard the platform 10 to cause the movement of the platform 10 so as to reach the desired working position. He/she can thus actuate the lifting mechanism 8 and the pivoting of the turret 4. It can be provided that he/she may also cause the movement of the aerial work platform on the ground.

It should be understood that a control station according to the invention can be mounted on the work platform of aerial work platforms having a different constitution, for example, which have another type of lifting mechanism 8 or which have no turret 4 in which case the lifting mechanism is mounted directly on the frame.

Figure 2:
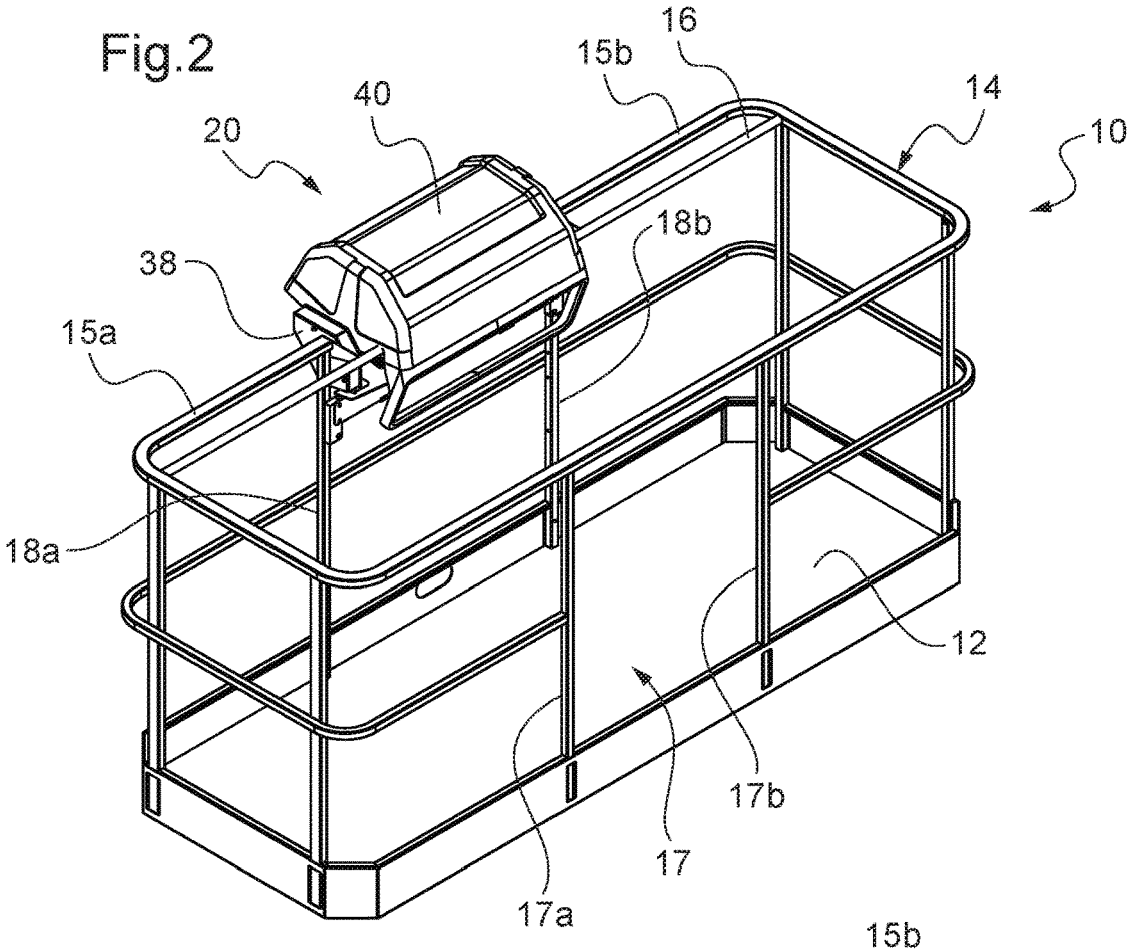
Figure 3:
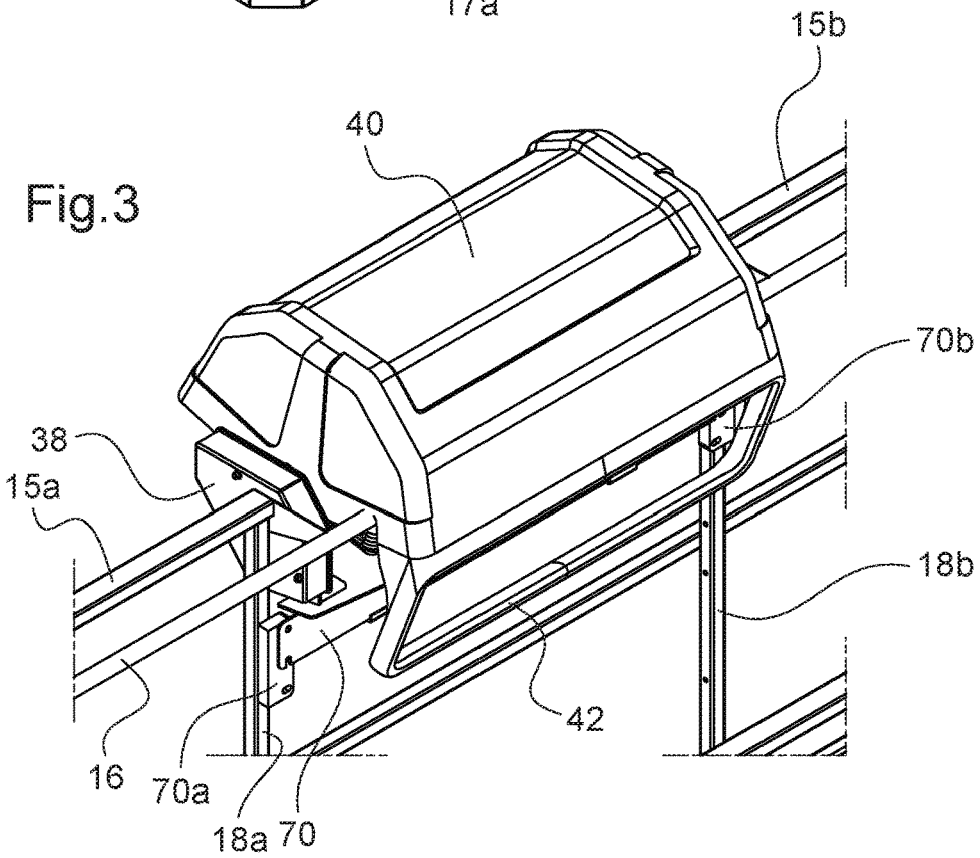

FIG. 2 shows the work platform 10. It comprises a floor 12 surrounded by a railing 14. An opening 17 between two uprights 17*a*, 17*b* of the railing 14 enable people to access the platform 10.

The control station 20 comprises a protective cover 40. The cover 40 is shown in closed position whereas it is shown in open position in FIG. 4.

Figure 4:
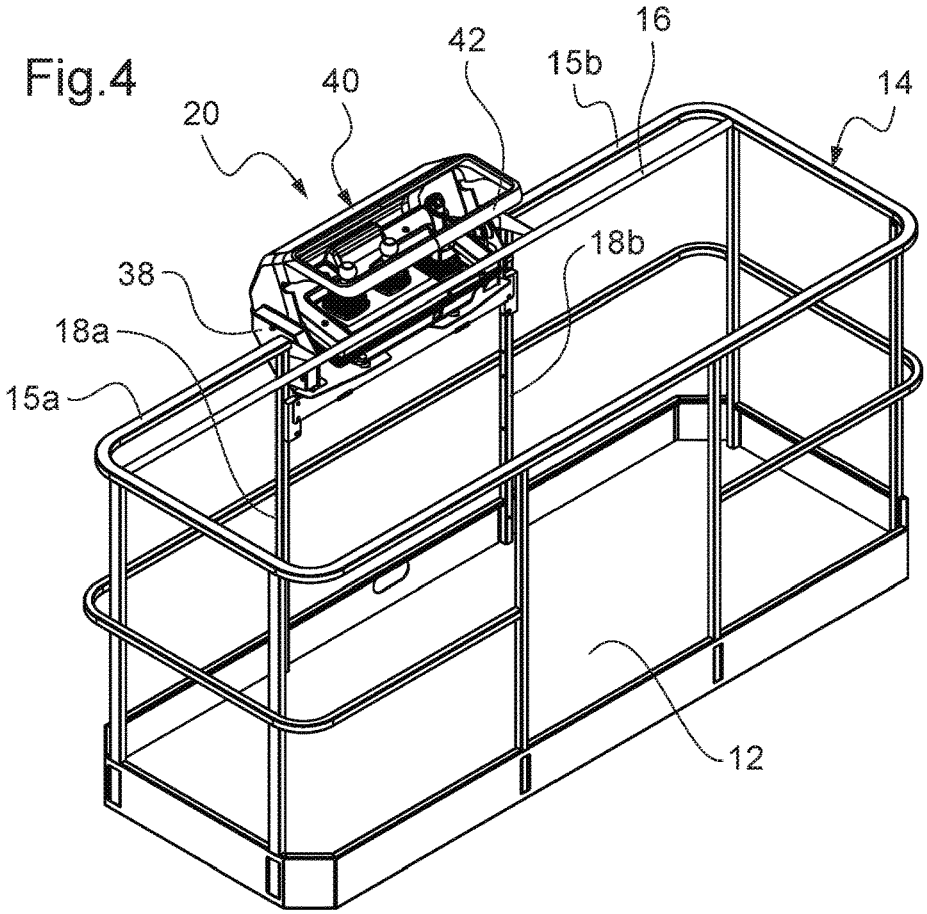
Figure 5:
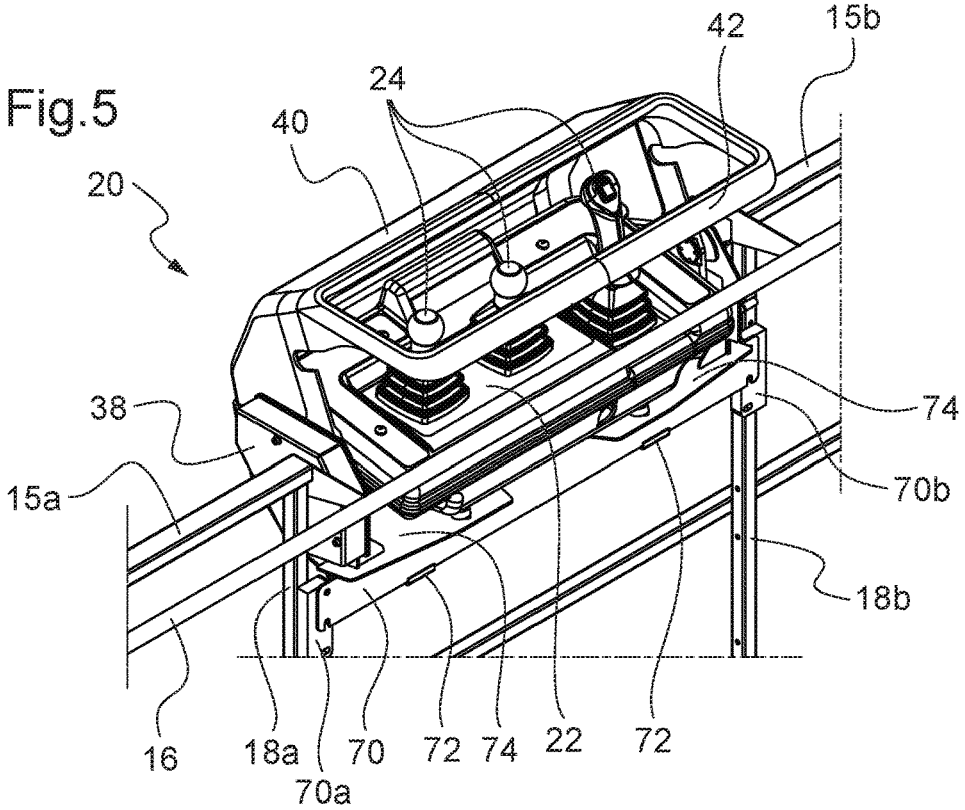
Figure 6:
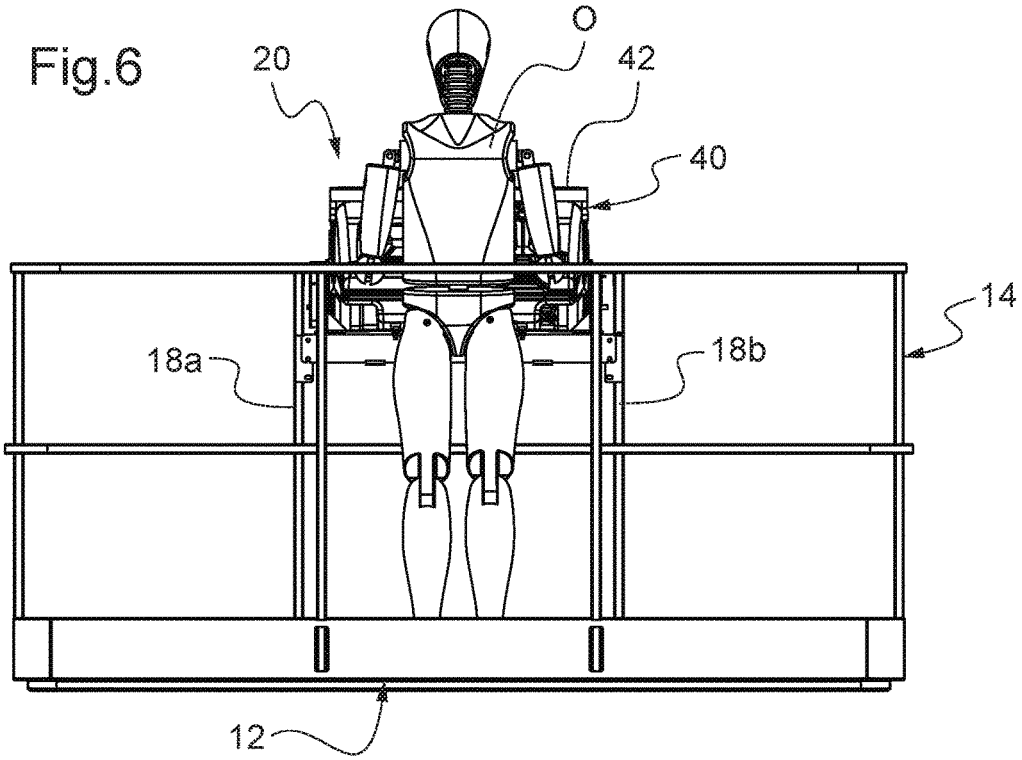

The control station 20 comprises a control console 22 visible in FIGS. 4 and 5. It is equipped with control members 24 intended to be manipulated by the operator O so that he/she can move the platform 10 up to the desired working position in height. The control console 22 is preferably mounted fixedly relative to the railing 14. In this case, it is mounted on support plates 74 welded to a bar 70 which is fixed to two vertical uprights 18*a*, 18*b* of the railing 14 via a respective spacer 70*a*, 70*b*.

As discussed in greater detail below, the switching of the cover 40 between the open and the closed positions is obtained by pivoting about an imaginary axis parallel to the front edge of the control console 22. The front edge of the console 22, and the front side thereof are conventionally defined as being those corresponding to the side of the console in front of which the operator O aboard the platform 10 stands for handling the control members 24. On the contrary, the rear side of the console 22 is the opposite side which is generally towards the outside of the platform 10.

When closed, the cover 40 covers the control console 22 and protects it against dirt and shocks during the work carried out by persons aboard the platform 10. In this position, the control members 24 are not accessible to the operator O. Accordingly, he/she cannot move the platform 10.

A bar 42 is fixedly arranged on the cover 40. It may for example be made integral with the cover 42 by molding of plastic or composite material or be added to the cover 40 by any suitable means such as screwing or welding depending on the cover material 40. The bar 42 in this case is straight and extends horizontally and at a distance from the front edge of the cover 40 while being parallel thereto. The bar 42 is extended, at the ends thereof, by two uprights giving a U-shaped overall form and used for arranging the bar 42 to the cover 40. However, various alternative solutions are possible. For example, an upright may be arranged centrally to the bar 42 to provide an overall T shape, with the bar 42 being arranged on the cover 40 through this upright. According to another alternative solution, the bar 42 may have a generally arcuate shape and be arranged directly on the cover 40 by its two opposite ends.

Figure 7:
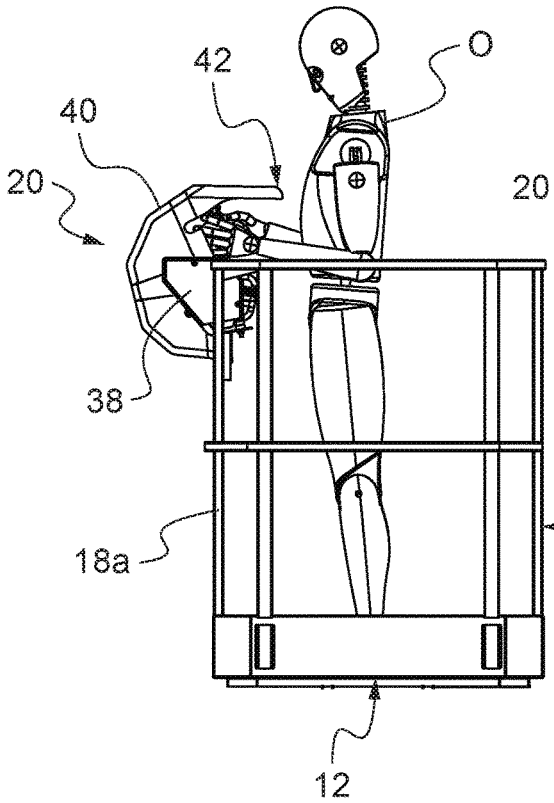

When the cover 40 is open, the bar 42 acts as a safety bar preventing the operator from being crushed on the console 22. It is then parallel to the front edge of the console 22 and extends along the front edge of the console 22 at a distance thereof. It projects relative to the front side of the console 22 in this case above the console 22. It is thus positioned between the torso of the operator O and the console 22 as seen in FIG. 7. The space between the front edge of the cover 40 and the bar 42 is free of material, which makes it possible for the operator O to see the control members 24 when the cover 40 is open. The operator O accesses the control members 24 by passing the hands underneath the bar 42.

Figure 8:
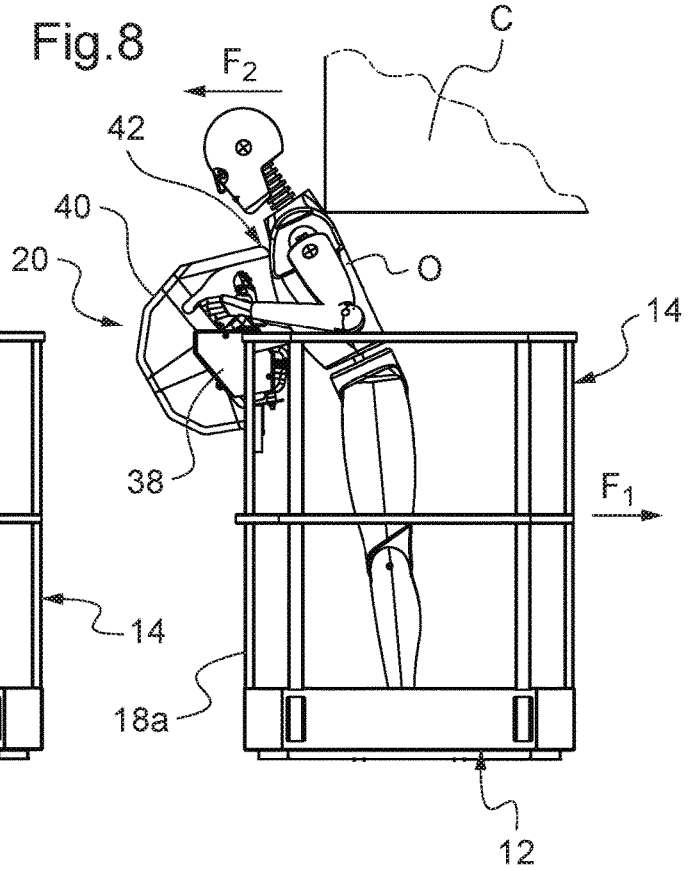
FIG. 8 shows a side view of the work platform of FIG. 1 with the operator standing in front of the control station and pushed against the latter by an external obstacle.

FIG. 8 illustrates the actuation of the bar 42 by the torso of the operator O who is pushed—see arrow $F_2$—toward the console 22 by an obstacle C hitting him/her from behind during the movement of the platform 10 as shown by the arrow $F_1$. The force exerted on the bar 42, if it exceeds a given level, results in the cover 40 moving toward the rear side of the console 22 and this movement is detected to automatically stop the current movement of the platform 10 to protect the operator O against crushing against the console 22.

FIGS. 9 to 13 illustrate the mounting of the cover 40 relative to the railing 14. More particularly, the cover 40 is mounted on each side to a vertical support 30 arranged fixedly relative to the railing 14. FIGS. 9 to 13 show the mounting thereof for one side, it being specified that it is identical for the other side of the cover 40. A cover guard 38 covering the support 30 has been omitted in these figures in order to show details of the assembly. Such cover guard is preferably screwed onto the support 30 for example to the points 36 and to the stud 32 visible in FIG. 13.

The side support 30 is welded, in this case, to the bar 70. The side supports 30 are arranged perpendicularly to the front edge of the console 22 and are mutually parallel. The cover 40 has a pin 44 on each side. The two pins 44 are coaxial about an imaginary axis which is parallel to the bar 42. Each pin 44 is inserted into a slot 34 provided in the corresponding vertical support 30. The two slots 34 are mutually parallel and extend toward the rear side of the console 22. The size thereof is suitable for enabling both pivoting and sliding of the pins 44 in the slots 34. The pins 44 are resiliently biased toward the front end of the slots 34. In this case, the resilient bias is provided by means of a respective tension spring 60 having one end connected to the pin 44 and the other end fixed to the stud 32 of the support 30.

Figure 9:
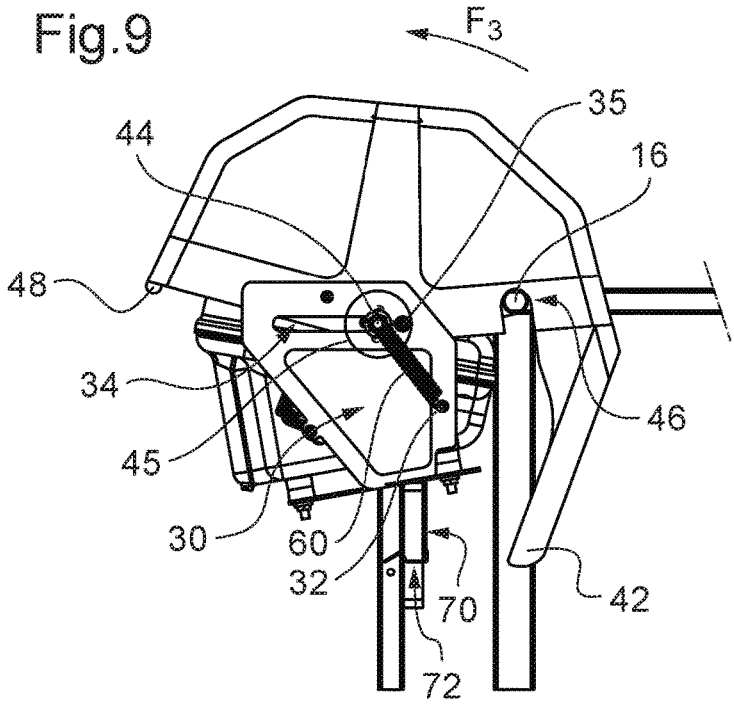
FIGS. 9, 10 and 11 are each a side view of the control station of FIG. 1 showing how to mount the protective cover to mounting brackets, with the protective cover being respectively in the closed position, in open position at rest, and in the open position, pushed by the operator to the rear side of the control console.

In the closed position which is illustrated by FIG. 9, the cover 40 rests by gravity in abutment against a horizontal bar 16 of the handrail 14, in this case by grooves 46 formed in the side parts of the cover 40. The grooves 46 in cooperation with the bar 16 also prevent any accidental pushing of the cover 40 toward the rear side of the console 22. Besides, the bar 42 is positioned downwards at a level below the console 22 and rearwards relative to the front edge of the cover 40. The bar 42 is thus protected against dirt and shocks during work performed by the persons aboard the platform 10.

Figure 10:
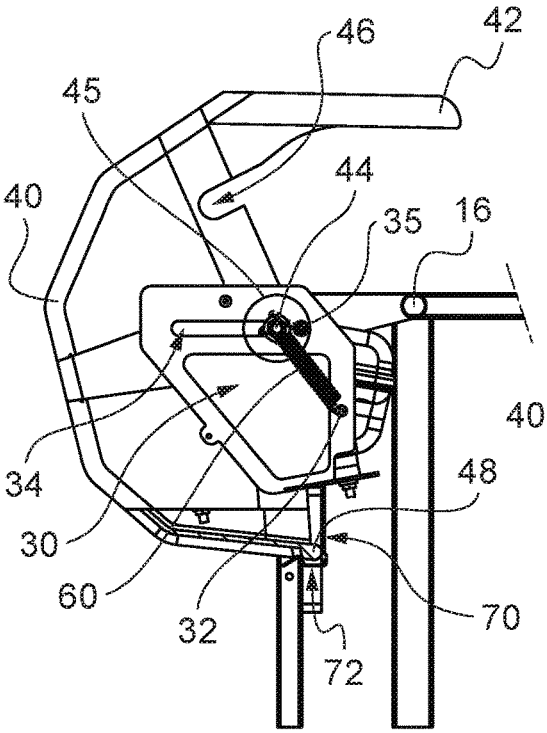

To switch the cover 40 from the closed position of FIG. 9 to the open position of FIG. 10, the operator O rotates it in the direction indicated by the arrow $F_3$, i.e. by tilting the cover 40 above the console 20 in the rearward direction. Such operation can be executed using the bar 42 as gripping means. The switching from the closed position to the open position is performed by mere pivoting because the springs 60 hold the pins against the front end of the slots 34. The springs 60 do not oppose the pivoting since they only exert a sliding action on the pins 44. When the cover 40 has reached the open position, the pivoting thereof is stopped by the rear edge 48 which abuts against the bar 70. In addition, two elastic leaves 72 fixedly arranged on the bar 70 cooperate with the rear edge 48 of the cover 4 to prevent the accidental pivoting thereof toward the closed position. Alternatively, such elastic leaves 72 are omitted and the cover 40 is held in the open position under the effect of its own weight.

The switching of the cover 40 from the open position to the closed position is similar by mere pivoting in the opposite direction after having overcome the elastic holding force of the leaves 72. Again, the bar 42 can be used as gripping means to close the cover.

FIGS. 4, 5 and 10 show the cover 40 in the open position at rest, i.e. in the absence of an external force pushing the bar 42 toward the console 22. On the contrary, when the operator O is standing in front of the control console 22 as shown in FIG. 7 and an obstacle C hits him/her from behind as shown in FIG. 8, he/she will be pushed toward the console 22—see arrow $F_2$—and will then rest against the bar 42 with his/her torso in this case. This force tends to rotate the cover 40 about the pins 44 in the direction of the arrow $F_3$ shown in FIG. 9, but such pivoting is blocked by the rear edge 48 of the cover 40 which abuts against the vertical wall of the bar 70. Therefore, when the force exerted on the bar 42—illustrated by the arrow $F_4$ on FIG. 11—overcomes the elastic return force developed by the springs 60, the pins 44 slide into the slots 34—see arrow $F_5$—and thus the cover 40 and the bar 42 move toward the rear side of the console 22.

A sensor detects the movement of the cover 40—and thus of the bar 42—toward the rear side of the console 22. In this case, the sensor 35 is an inductive one fixedly mounted on the support 30 which cooperates with a disk 45 mounted coaxially with the pin 44. When the pin 44 is at the front end of the slot 34, the sensor 35 faces the disk 45. This is the case in the closed position of the cover 40 illustrated in FIG. 9 and in its open position illustrated in FIG. 10 and in any intermediate pivoted position between these two positions upon opening or closing the cover 40. On the other hand, when the pin 44 slides in the slot 34 toward the rear beyond a given position, the sensor 35 no longer faces the disk 45 as seen in FIG. 11.

The sensor 35 is connected to the electronic circuit of the control station 20 which stops the current movement of the platform 10 when the sliding beyond this position is detected by the sensor 35. Stopping the current movement of the platform 10 means stopping any current movement, instructed by the operator O from the console 22, of the lifting mechanism 8 and the turret 4, and if any the movement of the aerial work platform on the ground. Detecting the sliding beyond this position is equivalent to detecting that the crushing force applied to the bar 42 toward the console 22 has exceeded a given threshold which corresponds to the return force developed by the springs 60 when the pins 44 are in this position.

It should be understood that other sensors may be used instead of inductive sensors 35 such as roller sensors or optical sensors. This system detecting the movement of the cover 40 can be implemented for one of the two pins 44 only, but it is preferable to do so for both pins for reliability and redundancy security reasons.

Figure 11:
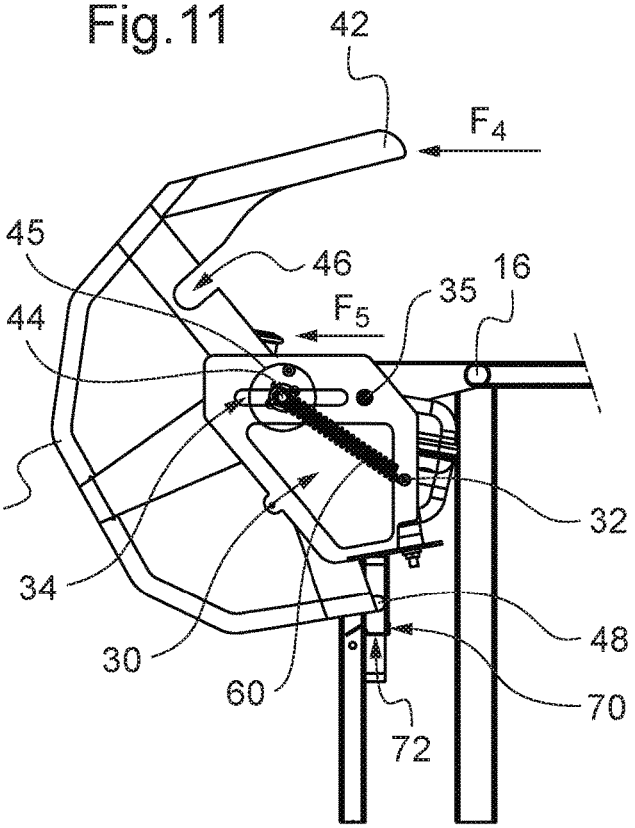
Figure 12:
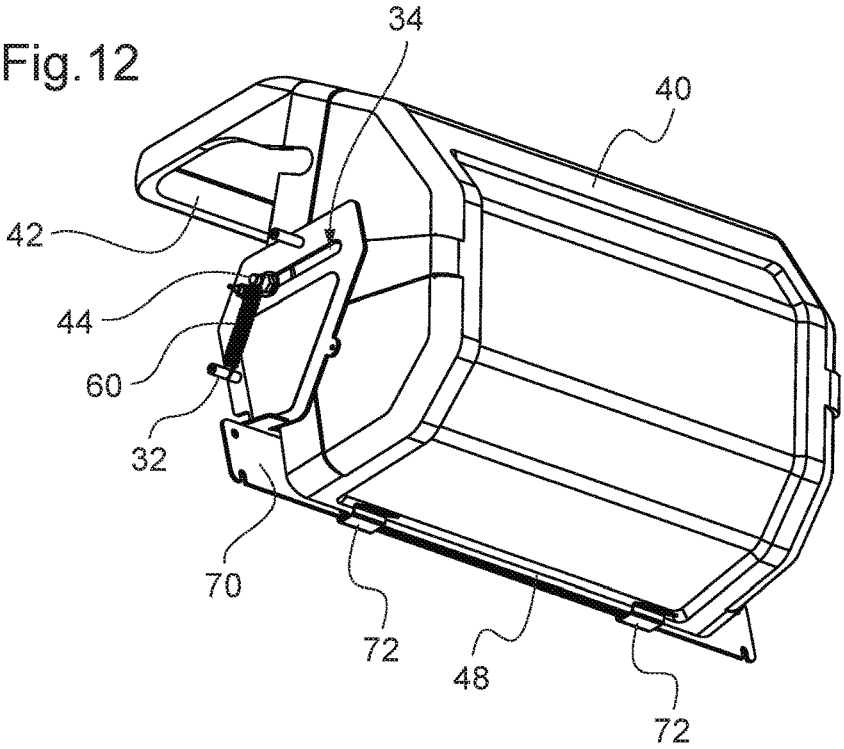
FIG. 12 shows a perspective view of the control station of FIG. 1 viewed from the back thereof, with the protective cover being in the open position at rest.
Figure 13:
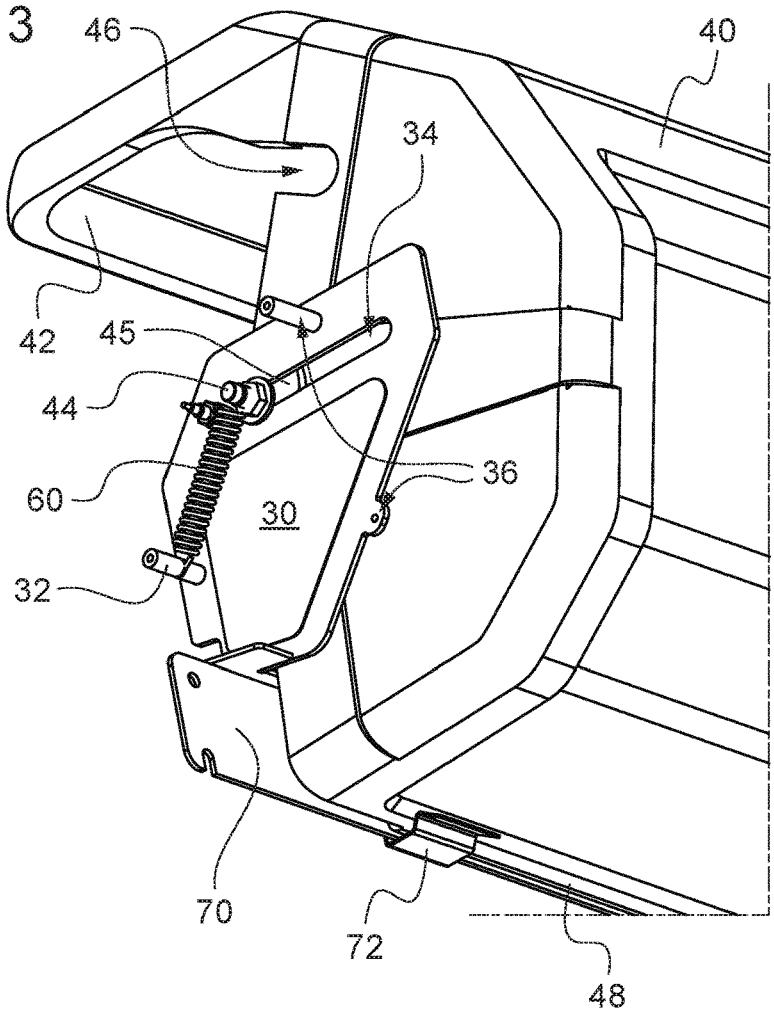
FIG. 13 is a local enlargement of FIG. 12 at the lateral side of the control station.

As can be seen in FIG. 11, the pin 44 can slide in the slot 34 toward the rear side of console 22 beyond the given position of detection of the movement of the pin 44. This makes it possible to go on limiting the crushing force which the operator O is exposed to if the platform 10 moves on by inertia effect.

When the action on the bar 42 ceases, the return springs 60 pull the pins 44 up to the front end of the slots 34 and thus bring the cover 40—and the bar 42—back to the rest position in the open position of FIG. 10.

The springs 60 are so selected as to develop a suitable return force to both effectively protect the operator O and avoid the inadvertent activation of the system detecting that the force has been exceeded. Preferably they are chosen so that the external force pushing the bar 42 which is necessary to move the bar 42 to the position in which the movement is detected by the sensor(s) 35 is less than or equal to 10 daN and greater than or equal 2 daN, whereas the detection of the movement of the bar 42 by the sensor(s) 35 preferably operates for a movement thereof of at least 2 cm as measured in a straight line from its rest position when the cover is open.

Figure 14:
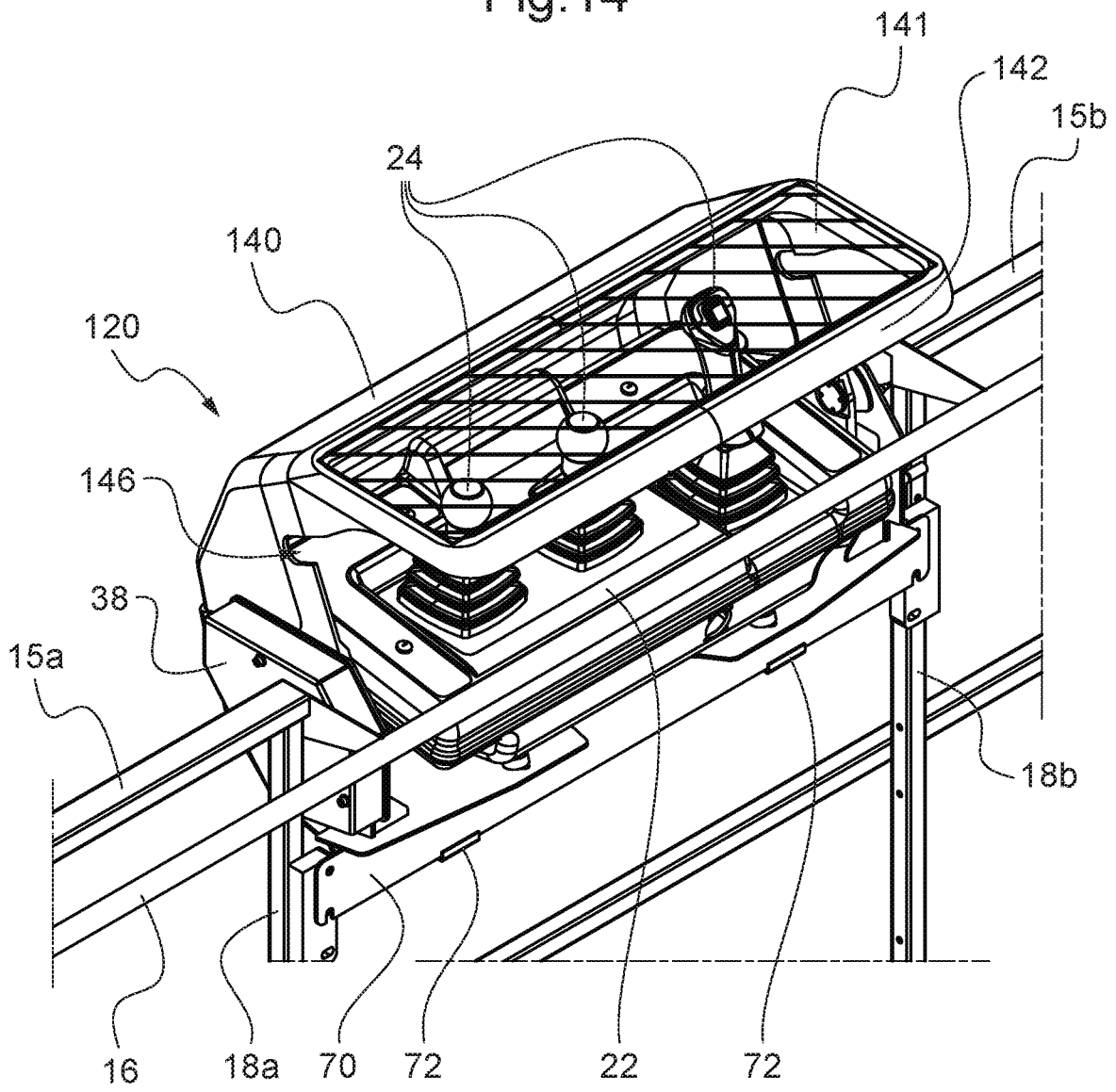
FIG. 14 shows a perspective view of a control station according to an alternative to that of FIGS. 1 to 13, with the protective cover being in the open position at rest.

FIG. 14 shows a perspective view of a control station 120 according to an alternative embodiment of the control station 20 of FIGS. 1 to 13, with the protective cover 140 being shown in the open position at rest. Identical elements have the same reference numbers. The bar 142 corresponds to the bar 42 of the control station 20. The only difference with the control station 20 resides in that the window which was defined between the bar 42 and the front edge of the cover 40 is no longer free of material, but provided with a transparent or translucent screen 141. The screen 141 makes it possible for the operator to see through the control members 24 when the cover 140 is open while they remain accessible for handling by passing the hands underneath the bar 142 as in the case for the control station 20. In this embodiment, the bar 142 then defines the front edge of the cover 140.

FIGS. 15 to 18 schematically illustrate one embodiment of the control station 220 which is an alternative embodiment of the control station 20 of FIGS. 1 to 13. Identical elements have the same reference numbers, whereas the modified elements have the same reference numbers plus 200. The difference from the control station 20 resides in the fact that the switching between the open and closed positions of the cover 240 occurs in an opposite direction relative to the cover 40 of the control station 20. In other words, the switching from the closed position—shown in FIGS. 15 and 16—to the open position—shown in FIGS. 17 and 18—is obtained by pivoting in the direction shown by arrow $F_6$, i.e. by tilting under the console 22, from the front to the rear of the console. When the cover 240 is closed, the safety bar 242, which is fixedly arranged to the cover 240, is thus positioned on the rear side of the console 22 and oriented towards the lower part thereof. The safety bar is then protected against dirt and shocks during the work executed by people aboard the platform. To facilitate the opening of the cover 240, the latter may have a relief or an opening forming a grip handle, in a cover area which is located toward the front side of the console 22 when in closed position. In this case, the cover 240 has a longitudinal rib 280 for this purpose.

When the cover 240 is open, the bar 242 protrudes from the front side of the console 22. It is then positioned between the console 22 and the operator standing in front of the console 22. The bar 242 then plays the role of safety bar against the operator's being crushed on the console 22 similarly to the case of the bar 42 of the control station 20. In this case, the waist, rather than the torso of the operator—having a stature as already mentioned—comes into contact with the bar 242 because the bar 242 is at a lower level than the bar 42 of the control station 20. If the operator presses hard enough on the bar 242—see the arrow $F_7$—, he/she will cause the sliding of the cover 240 toward the rear side of the console 22: see the arrow $F_8$.

The cover 240 can be mounted to the railings similarly to the case of the cover 40, i.e. using pins cooperating with slots provided in vertical supports attached to the railing—similar to the supports 30 but not shown in this case as covered by guards 238—and biased by return springs to enable pivoting and sliding of the cover 240. Therefore, the assembly is not explained in details again. Pin sliding can be detected in the same manner. Some changes are made to enable the tilting of the cover 240 under the console 22. In particular, the bars 16 and 70 are removed and the console supports 22—not shown—are adapted and fixed laterally to the uprights 18*a*, 18*b*. The stop function for the cover 240 in the closed position of the bar 16 can be exerted by a stop fixed on the supports of the console 22 or on the above-mentioned vertical supports. Similarly, the stop function stopping the pivoting of the cover 240 in the open position and stopping the pivoting thereof if the bar 242 is pushed toward the console 22 in accordance with the arrow $F_7$ is adapted and may be carried out in cooperation with the sides of the cover 240. The elastic leaves 72 may be removed or replaced by elastic leaves provided on the aforementioned vertical supports attached to the railings and cooperating with the sides of the cover 240.

The present invention is of course not limited to the examples and the embodiments described and illustrated above but can be the object of numerous alternative solutions accessible to the person skilled in the art. Thus, the bar 42 may not be fixedly arranged on the cover 40, but still be linked to the cover so as to move together, between the open and closed positions of the cover. For example, the cover and the bar may be mounted on each side by mere pivoting about a common imaginary axis relative to the railing of the platform and be linked together at the pivotal connections by torsion springs. More specifically, one end of the torsion spring is supported by a first stop provided on the side of the cover whereas the other end of the spring is supported on the lateral upright of the U-shaped bar so as to elastically bias this upright against another stop provided on the side of the cover and which is angularly offset relative to the first stop. The cover and the bar thus pivot together upon switching of the cover between the open and closed positions. The spring stiffness is so selected as to be sufficient to avoid or limit the pivoting of the bar relative to the cover during the cover opening operation. In the open position, the cover bears against a fixed stop connected to the railing of the platform and preventing same from pivoting beyond this position. On the other hand, the bar can continue to rotate in the same direction—i.e. in the direction towards the opening of the cover—by overcoming the resilient force of the torsion spring. Such additional pivoting of the bar after the cover is stopped in the open position can be detected by a suitable sensor for determining a situation of crushing of the operator against the bar.

The invention claimed is:

1. A control station for a work platform of an aerial work platform, comprising:

a control console whereon control members are arranged;

a cover for protecting the control console moveably mounted between:

a first position in which the cover is closed to cover the control console, and a second position in which the cover is open to make it possible to manipulate the control members from the front side of the console;

a longitudinal member linked to or making part of the cover to simultaneously move between the first position and the second position, which longitudinal member extends at a distance along the front side of the console and protrudes with respect to the front side of the console when the cover is in the second position; and means for detecting an external action pushing the longitudinal member toward the console when the cover is in the second position, wherein the cover moves by tilting or pivoting between the first position and the second position.

2. The control station of claim 1, wherein when the cover is in the second position, the longitudinal member is arranged to move toward the rear side of the console when subjected to an external action pushing same toward the console and the detecting means operate by detecting the movement of the longitudinal member toward the rear side of the console.

3. The control station of claim 2, wherein the detecting means operate by detecting the movement of the longitudinal member beyond a predetermined position toward the rear side of the console, the longitudinal member being adapted to move toward the rear side of the console beyond said predetermined position.

4. The control station of claim 1, wherein the detecting means operate by detecting that a threshold of the force of the external pushing action pushing the longitudinal element toward the console has been exceeded.

5. The control station of claim 1, wherein, when the cover is in the second position, the longitudinal element is held in position against an external action pushing the longitudinal element toward the console up to a given level of pushing force beyond which the longitudinal element moves toward the rear side of the console.

6. The control station of claim 5, wherein the longitudinal element is thus held in position by return means developing a returning force onto the longitudinal element throughout the movement of the longitudinal element toward the rear side of the console.

7. The control station of claim 1, wherein the longitudinal element is fixedly arranged on the cover.

8. The control station of claim 1, wherein the longitudinal element is:

either the front edge of the cover, or a bar arranged fixedly on the cover at a distance from the front edge of the cover to define at least one free space between the bar and the front edge of the cover, with the front edge of the cover being the edge of the cover toward the front side of the console when the cover is in the second position.

9. An aerial work platform, comprising:

a work platform;

a mechanism for lifting the work platform; and a control station arranged on the work platform and making it possible for an operator to cause the work platform to move, the control station comprising:

a control console whereon control members are arranged;

a cover for protecting the control console moveably mounted between:

a first position in which the cover is closed to cover the control console, and a second position in which the cover is open to make it possible to manipulate the control members from the front side of the console;

a longitudinal member linked to or making part of the cover to simultaneously move between the first position and the second position, wherein:

the cover moves by tilting or pivoting between the first position and the second position, and when the cover of the control station is in the second position, the longitudinal member extends at a distance along the front side of the console and protrudes with respect to the front side of the console and at least one sensor is arranged to detect an external action pushing the longitudinal member toward the console.

10. The aerial work platform of claim 9, wherein the at least one sensor of the control station causes movement of the work platform to stop upon detecting an external action pushing the longitudinal element toward the control console when the cover is in the second position.

11. The aerial work platform of claim 9, wherein when the cover of the control station is in the second position, the longitudinal member is arranged to move toward the rear side of the console when subjected to an external action pushing same toward the console and the at least one sensor operate by detecting the movement of the longitudinal member toward the rear side of the console.

12. The aerial work platform of claim 11, wherein the at least one sensor of the control station operates by detecting the movement of the longitudinal member beyond a predetermined position toward the rear side of the console, the longitudinal member being adapted to move toward the rear side of the console beyond said predetermined position.

13. The aerial work platform of claim 9, wherein the at least one sensor operates by detecting that a threshold of the force of the external pushing action pushing the longitudinal element toward the console has been exceeded.

14. The aerial work platform of claim 9, wherein, when the cover is in the second position, the longitudinal element of the control station is held in position against an external action pushing the longitudinal element toward the console up to a given level of pushing force beyond which the longitudinal element moves toward the rear side of the console.

15. The aerial work platform of claim 9, wherein the longitudinal element is:

either the front edge of the cover, or a bar arranged fixedly on the cover at a distance from the front edge of the cover to define at least one free space between the bar and the front edge of the cover, with the front edge of the cover being the edge of the cover toward the front side of the console when the cover is in the second position.

16. The aerial work platform of claim 9, wherein:

the control members of the control console allow an operator to cause the work platform to move, when the cover is in the second position, the longitudinal member extends between the control console and where an operator onboard the work platform would stand in front of the control console, and the at least one sensor of the control station causes movement of the work platform to stop upon detecting an external action pushing the longitudinal element toward the control console when the cover is in the second position.

17. The aerial work platform of claim 16, wherein when the cover is in the second position, the cover prevents access by the operator to the control members of the control panel.

18. The aerial work platform of claim 16, wherein the control station is arranged so that when the cover is in the second position, an operator standing in front of the control console would push the longitudinal element with either the torso or the waist when the operator is pushed toward the console by an obstacle hitting the operator from behind during a movement of the work platform, the operator referring to a person with a stature chosen between 1.70 m and 1.90 m.

19. An aerial work platform, comprising:

a work platform;

a mechanism for lifting the work platform; and a control station arranged on the work platform, the control station comprising:

a control console whereon control members are arranged, the control members making it possible for an operator to cause the work platform to move;

a cover for protecting the control console moveably mounted between:

a first position in which the cover is closed to cover the control console, and a second position in which the cover is open to make it possible to manipulate the control members from the front side of the console;

a longitudinal member linked to or making part of the cover to simultaneously move between the first position and the second position, wherein:

the cover of the control station is mounted relative to the console through both a pivoting and sliding connection so that:

the cover can be moved between the first position and the second position by pivoting the cover; and when the cover is in the second position, the cover can slide toward the rear side of the console when the longitudinal element is subjected to an external action pushing the longitudinal element toward the console, when the cover of the control station is in the second position, the longitudinal member extends at a distance along the front side of the console and protrudes with respect to the front side of the console, and at least one sensor is arranged to detect an external action pushing the longitudinal member toward the console.

20. The aerial work platform of claim 19, wherein:

the control station is arranged so that when the cover is in the second position, an operator standing in front of the control console would push the longitudinal element with either the torso or the waist when the operator is pushed toward the console by an obstacle hitting the operator from behind during a movement of the work platform, the operator referring to a person with a stature chosen between 1.70 m and 1.90 m, and the at least one sensor of the control station causes movement of the work platform to stop upon detecting an external action pushing the longitudinal element toward the control console when the cover is in the second position.

* * * * *